US007810358B2

(12) United States Patent
Stingel et al.

(10) Patent No.: US 7,810,358 B2
(45) Date of Patent: Oct. 12, 2010

(54) LATCH-TYPE NEEDLE WITH SLIDING SURFACE

(75) Inventors: Uwe Stingel, Meβstetten (DE); Frank Weihing, Gomaringen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/620,646

(22) Filed: Nov. 18, 2009

(65) Prior Publication Data

US 2010/0147037 A1 Jun. 17, 2010

(30) Foreign Application Priority Data

Dec. 12, 2008 (EP) ..... 08171577

(51) Int. Cl.
*D04B 35/04* (2006.01)

(52) U.S. Cl. ..... 66/121

(58) Field of Classification Search ..... 66/116, 66/120, 121, 122

See application file for complete search history.

(56) References Cited

U.S. PATENT DOCUMENTS 662,542 A * 4/1899 Ruth ..... 66/143
1,116,190 A * 11/1914 Williams ..... 66/111
2,495,543 A * 1/1950 Peberdy ..... 66/111
4,441,339 A * 4/1984 Yorisue ..... 66/111
4,916,925 A * 4/1990 Pernick ..... 66/141
6,907,758 B2 * 6/2005 Traenkle et al. ..... 66/141

FOREIGN PATENT DOCUMENTS

WO WO 2007/074486 A1 7/2007

* cited by examiner

*Primary Examiner*—Danny Worrell
(74) *Attorney, Agent, or Firm*—Robert P. Michal, Esq.; Lucas & Mercanti, LLP

(57) ABSTRACT

A latch-type needle that is particularly suitable for knitting machines that work without sinkers includes a latch that preferably carries on its outermost end a cam or extension, the cam or extension is provided with a sliding surface. The sliding surface may move along a complementary sliding or runner surface and temporarily prevent the latch from pivoting out of its open position, for example. A corresponding wear of material is concentrated on the sliding surface. A damage, deformation or impairment of other parts of the spoon or latch head, in particular of either of its edges, is prevented.

11 Claims, 3 Drawing Sheets

LATCH-TYPE NEEDLE WITH SLIDING SURFACE

CROSS-REFERENCE TO RELATED APPLICATION

This application claims the benefit under 35 USC 119 of European Patent Application No. 08 171 577.3 filed Dec. 12, 2008, the entire disclosure of which is incorporated herein by reference.

FIELD OF THE INVENTION

The invention relates to a latch-type needle for knitting machines, in particular for knitting machines without holding-down/knock-over sinkers.

BACKGROUND INFORMATION

Document WO 2007/074486 A1 discloses a knitting machine that comprises a knitting cylinder with needle channels on the circumference of the knitting cylinder. Latch-type needles are seated in these needle channels, said needles being arranged so as to be movable in longitudinal direction. A ring-shaped stationary cam assembly consisting of several segments and enclosing the knitting cylinder is provided for controlled longitudinal shifting, said cam assembly having at least two control paths. The latch-type needles have feet that are in engagement with said control paths. For example, as a result of this, the even-numbered latch-type needles are moved by one control path, and the odd-numbered knitting needles are moved by the other control path. As a result of this, the even-numbered and the odd-numbered knitting needles are driven out in two shafts that are offset relative to each other as to location, so that the needles of one group prevent the knit material from rising when the needles of the other group are driven out. Consequently, holding-down/knock-over sinkers become superfluous.

Considering this arrangement, a thread guide is used, said guide being located in the immediate vicinity of the driven-out knitting needles and coming into contact with the latches of the knitting needles. This effect may be desirable in order to hold the latches in their open position, i.e., rearward position. However, the contact between the thread guide and the latches results in wear that may result in undesirably sharp edges on the latch, in particular on the spoons of said latches.

Inasmuch as the aforementioned knitting machine does not require any holding-down sinkers, the machine allows the production of particularly fine knits with very small stitches because the latch-type needles can be arranged very tightly next to each other. The constructional space that is otherwise needed for the sinkers is now available for the latch-type needles. However, the aforementioned wear of the latch-type needles is undesirable.

OBJECT AND SUMMARY OF THE INVENTION

Considering this, it is an object of the invention to provide an improved latch-type needle.

The latch-type needle in accordance with the invention has a cam on the latch, said cam being provided with a sliding surface. This cam is suitable to come into contact with corresponding sliding surfaces of an abutment means of the thread guide, for example in the form of a separate runner and move along said runner. As a result of this, the cam can support the latch on the sliding surface of the abutment means and prevent the latch from being pivoted out of its rearward position. In other words, the sliding surface provided on the abutment means may hold the latch in open position, whereby the cam of the latch moves or slides along this sliding surface.

As a rule, the wear occurring on the cam can be tolerated. Furthermore, the sliding surface of the cam is configured in such a manner that, because of the sliding of the sliding surface, flat regions or facets that do not have sharp peripheral edges are formed.

Preferably, the cam is arranged on the end of the spoon of the latch that extends away from the shank. This is the end that is the farthest from the pivot bearing support of the latch. Alternatively, the cam may also be arranged at another location, for example, between the spoon and the shank of the latch.

Preferably, the latch is configured so as to be symmetrical with respect to a latch center plane on which the pivot axis of the latch is positioned perpendicularly. In particular, the cam is preferably arranged so as to be symmetrical with respect to such a latch center plane. Optionally, for example when the direction of rotation of the knitting machine has been clearly defined, the cam may alternatively also be arranged so as to be asymmetrical with respect to the latch center plane.

The sliding surface provided on the cam is preferably somewhat crowned, i.e., convexly curved relative to the longitudinal direction of the latch as well as also relative to the transverse direction of the latch. The curvature of the sliding surface may be different in longitudinal and transverse directions. The curvature may also be slightly spherical. The convex, crowned sliding surface may have a flat regions caused by wear, in which case the risk of the formation of sharp edges on the sliding surface is greatly reduced and, preferably, does not exist.

The preferably crowned sliding surface of the cam preferably extends beyond a plane defined by the spoon edge of the latch. In a needle with a saw cut in the spoon, said needle having a latch with spoons having a recess for the accommodation of the hook the spoon edge represents the edge circumscribing the recess of the spoon. In a male latch-female hook needle (i.e., a needle whose hook has a recess for the accommodation of a lower edge of the head of the latch) the "spoon edge" is to be viewed as the lower edge of the latch head which—in this case—does not have a recess at this point. Inasmuch as the cam is raised above the edge, it does represent a wear reserve that ensures that the edge is kept away from the sliding surface of the thread guide of a runner, said runner being arranged in a stationary manner relative to the thread guide. The contact of the edge of the spoon with other machine parts and a wear of the edge are prevented.

Preferably, the cam is narrower than the spoon of the latch. Preferably, the width of the cam corresponds approximately to the width of the shank of the latch. Consequently, it becomes possible that the cam does not disrupt the knitting operation.

Preferably, the cam is shorter than the spoon. Measured in longitudinal direction of the latch, the length of the cam is preferably not greater than two thirds of the length of the spoon. Also this measure is disposed to not disrupt the knitting operation. In addition, the inertia of the latch is only slightly increased by the cam, so that the dynamic properties of the latch needle remain good.

Additional details of advantageous embodiments of the invention are obvious from the description of the drawings or the sub-claims. In so doing, the description is restricted to essential aspects of the invention and miscellaneous situations.

The features and advantages of the claimed invention will become apparent from the following description of preferred embodiments of the invention, given by way of example only, which is made with reference to the accompanying drawings.

BRIEF DESCRIPTION OF THE DRAWINGS

The drawings are to be referred to as being supplementary.

DESCRIPTION OF THE PREFERRED EMBODIMENT

Figure 1:
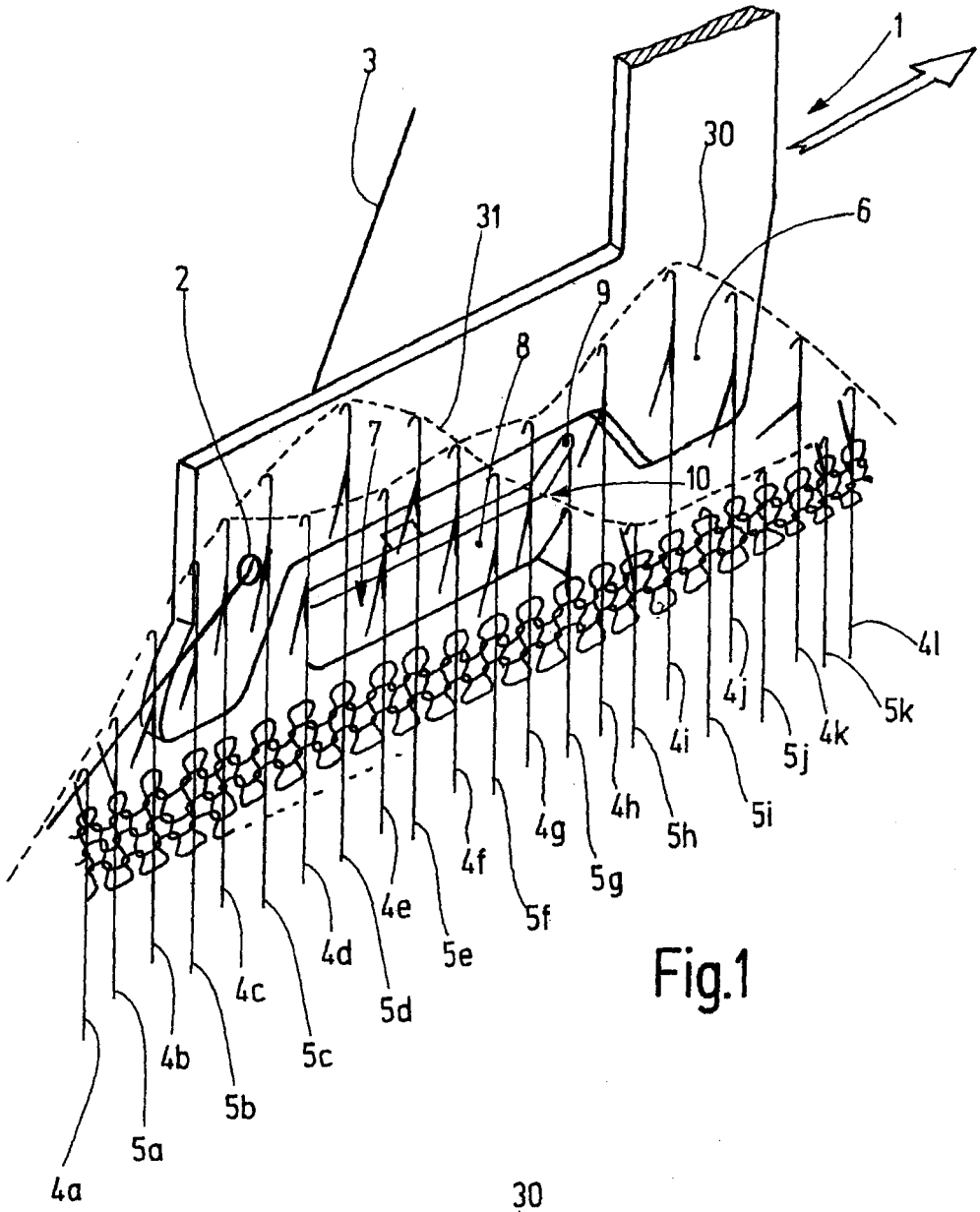
FIG. 1 is a schematized illustration of a knitting system comprising several knitting needles in accordance with the invention.

FIG. 1 shows a knitting site of a knitting machine. A thread guide 1 is preferably held in a stationary manner on the knitting machine. At one end, said thread guide has at least one passage opening 2 that acts as an eyelet for supplying a thread 3. Driven-out latch-type needles 4 (4*a* through 41) and 5 (5*a* through 5*k*) move along a sliding surface 6. In addition, a runner 7 having a sliding surface 8 may be provided. The sliding surface 8 may be arranged in one plane together with the sliding surface 6 and form the abutment means for the latch-type needles 4, 5. The runner 7 may be arranged in a trapeze-shaped cutout of the thread guide 1. The runner 7 may be fastened to the thread guide 1 or to another point of the knitting machine, said point being stationary relative to the knitting site. In addition, the runner 7, as is obvious from FIG. 1, may have a slightly bent end 9 with a start-up surface 10.

The sliding surfaces 6 and 8 are disposed to hold the latches 16 provided on the latch-type needles 4, 5 in open position. To accomplish this, at least a few of the latch-type needles 4 and/or 5 are configured in a specific manner as is obvious from FIG. 3 and explained with reference to the example of latch-type needle 4.

The latch-type needle 4 has a needle body 11 with a longitudinal shank 12 that is provided with a hook 13 on one end. The hook of the longitudinal shank 12 terminates in a tip 14. A latch slot 15 extending in longitudinal direction of the shank is provided in the shank, whereby a latch 16 is pivotally supported in said slot. This is accomplished with a latch bearing support 17 for the latch 16 that defines a pivot axis in a direction transverse to the shank 12 as well as to the latch 16. To this extent, the latch-type needle 4 essentially corresponds to a conventional latch-type needle.

Figure 3:
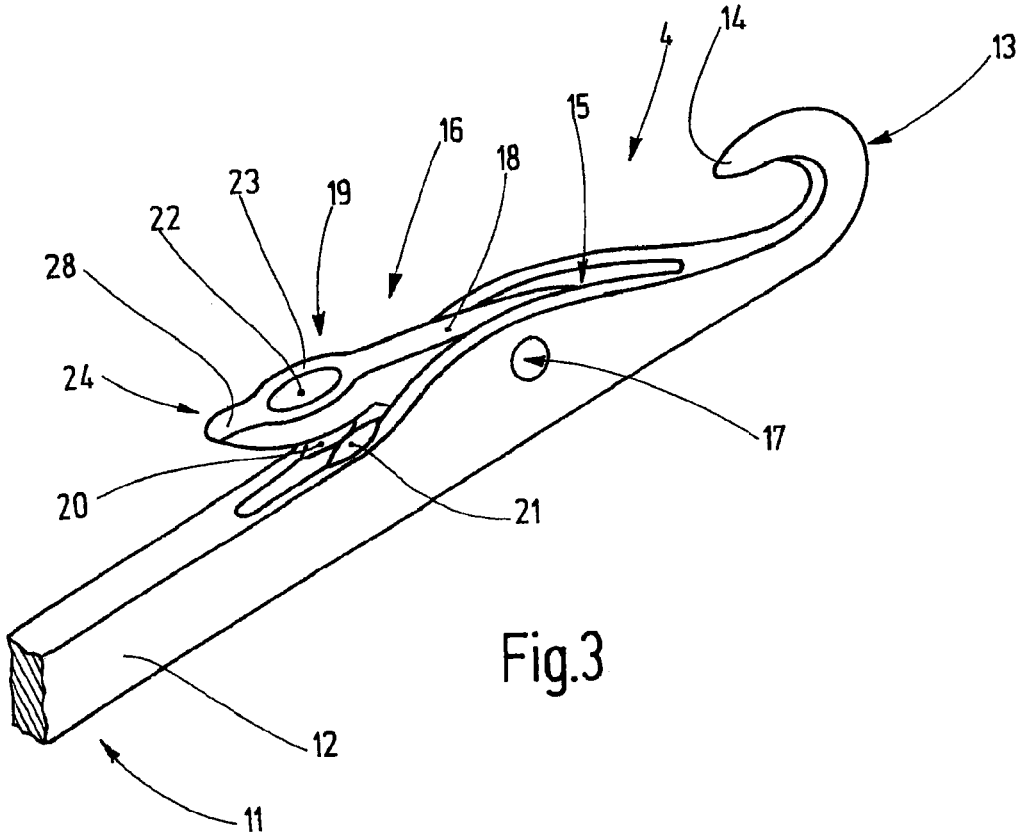
FIG. 3 is a perspective view of a detail of a general arrangement drawing of a latch-type needle of the knitting 25 system in accordance with FIGS. 1 and 2.

The latch 16 has a shank 18 that extends into the latch slot 15 and is pivotally supported on the latch bearing support 17. To do so, the shank 18 is provided with an appropriate receiving feature which come into engagement with pins or projections on the lateral walls that delimit the latch slot 15. On its end away from the latch bearing support 17, the shank 18 supports a latch head 19 that has the shape of a spoon, which as shown in FIG. 3, may move to be seated in the recesses 20, 21 provided on the lateral walls. The spoon 19 is slightly wider than the shank 18 and adjoins said shank without forming an edge or a step. On its upper side (in rearward position) and its side facing the hook 14 (in closed position), the spoon 19 is provided with a recess 22 that is also referred to as "saw cut." As is obvious from the closed position shown in FIG. 5, the recess 22 is configured in such a manner that the tip 14 of the hook 13 is received—in closed position—by the recess 22. The recess 22 is circumscribed by an edge that preferably is approximately in one plane.

Figure 4:
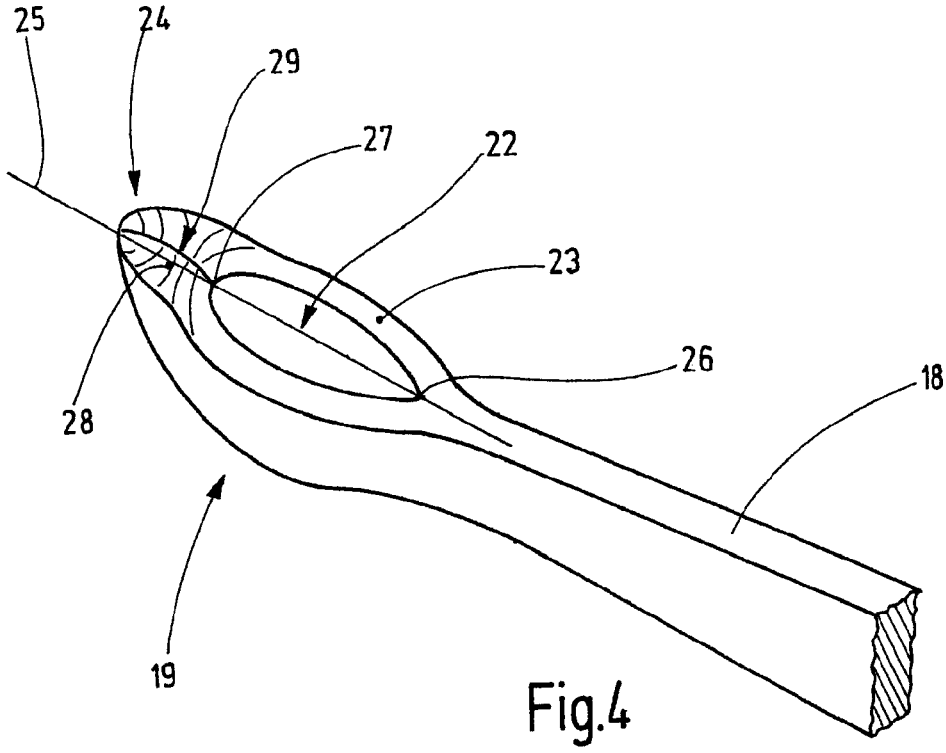
FIG. 4 is a separate perspective illustration of the spoon of the latch-type needle in accordance with FIG. 3, said illustration having been enlarged compared with FIG. 3.
Figure 5:
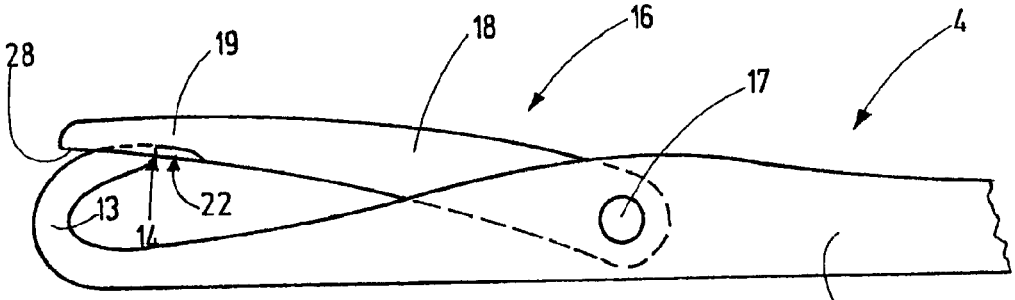
FIG. 5 is a side view of the latch-type needle in accordance with FIG. 3.
Figure 6:
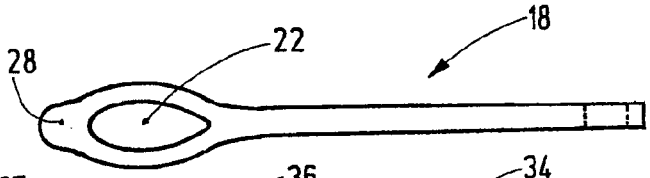
FIG. 6 is a plan view of the underside of the latch of 5 the latch-type needle in accordance with FIG. 5.

From the end of the spoon 19 opposite the shank 18 is an extension 24 that is essentially located in a straight extension of the shank 18. This is obvious from FIG. 4. There, the extension 24 extends along the longitudinal direction 25 of the latch 16 that is shown with reference to a line 25 that connects the shank-side endpoint 26 of the recess 22 with the cam-side endpoint 27 of the recess. The cam 24 comprises a sliding surface 28 that rises above this line 25. Preferably, the sliding surface 28 is slightly crowned, i.e., convex. It rises above the line 25, as is indicated in FIG. 5 by a line 29 following the surface of the sliding surface 28. Consequently, the sliding surface 28 is curved relative to the longitudinal direction of the latch. In addition, said sliding surface is preferably curved in the transverse direction of the latch.

In so doing, the sliding surface 28 also rises above the plane that is defined by the edge 23 of the recess 22. This is at least partially true, even if the edge 23 itself is not curved but is located in a plane.

In longitudinal direction 25 of the latch, the extension is smaller than the distance measured between the endpoint 26 of the latch shank 18 and the endpoint 27 of the recess 22. In other words, in longitudinal direction of the latch, the cam 24 is smaller than the length of the saw cut 22.

Figure 2:
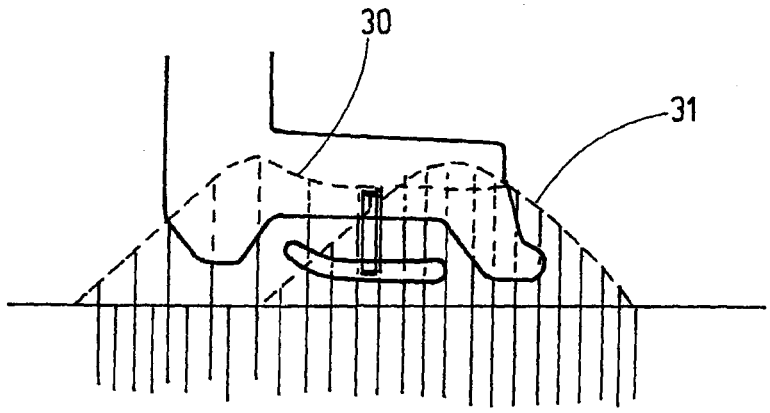
FIG. 2 is a further schematized illustration of the knitting system in accordance with FIG. 1.

The latch-type needle 4 that has been described so far operates as follows:

As illustrated by FIG. 1, the needles 4*a* through 41 and 5*a* through 5*k* are associated with two different groups of needles that are driven out following different curves 30, 31. This is shown by FIG. 1 and, in addition, schematically illustrated by FIG. 2. The needle 4 is driven out following the positions 41, 4*k*, etc., until the needle is again retracted corresponding the positions 4*c*, 4*b* and 4*a*. The needle 5 is driven out following the positions of the needles 5*h* through 5*d* until the needle 5 is again retraced corresponding to the positions of the needles 5, 5*b* and 5*a*. In so doing, the latches 16 of the driven out needles 4 and 5 are continuously in open position. In order to remain in this open position, the cams 24 of the latches 16 may move along the sliding surfaces 6 and 8. As a result of the crowned curvature of the sliding surface 28 and it being raised above the edge 23 of the spoon 19, a premature weakening or damaging of the edge 23, in particular, also a chamfering thereof, or a formation of burrs along the edges 23 is effectively prevented. For this to occur, it is sufficient if the highest point of the sliding surface 28 has a distance of 0.03 mm relative to the line 25. Preferably, the distance, i.e., the highest elevation of the sliding surface 28 is slightly greater, however.

Figure 8:
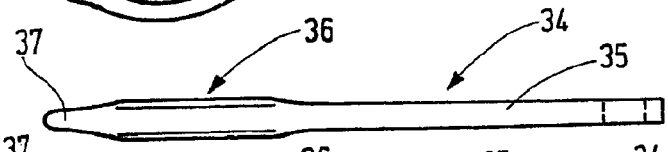
FIG. 8 is a schematized plan view of the underside of the latch of the latch-type needle in accordance with FIG. 7.
Figure 7:
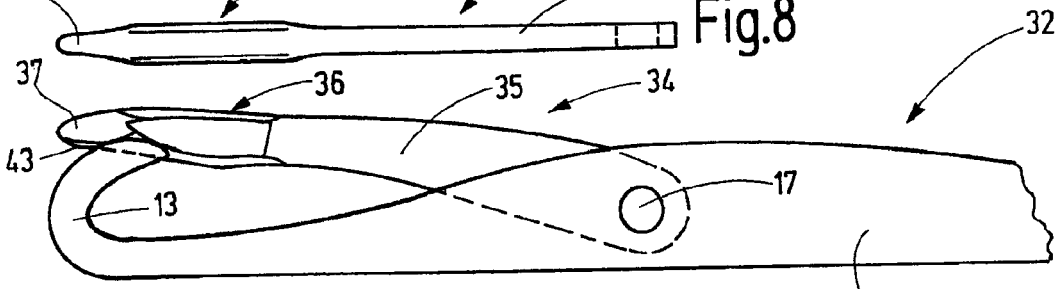
FIG. 7 is a side view of a modified embodiment of the latch-type needle, i.e., a male latch-female hook needle.
Figure 9:
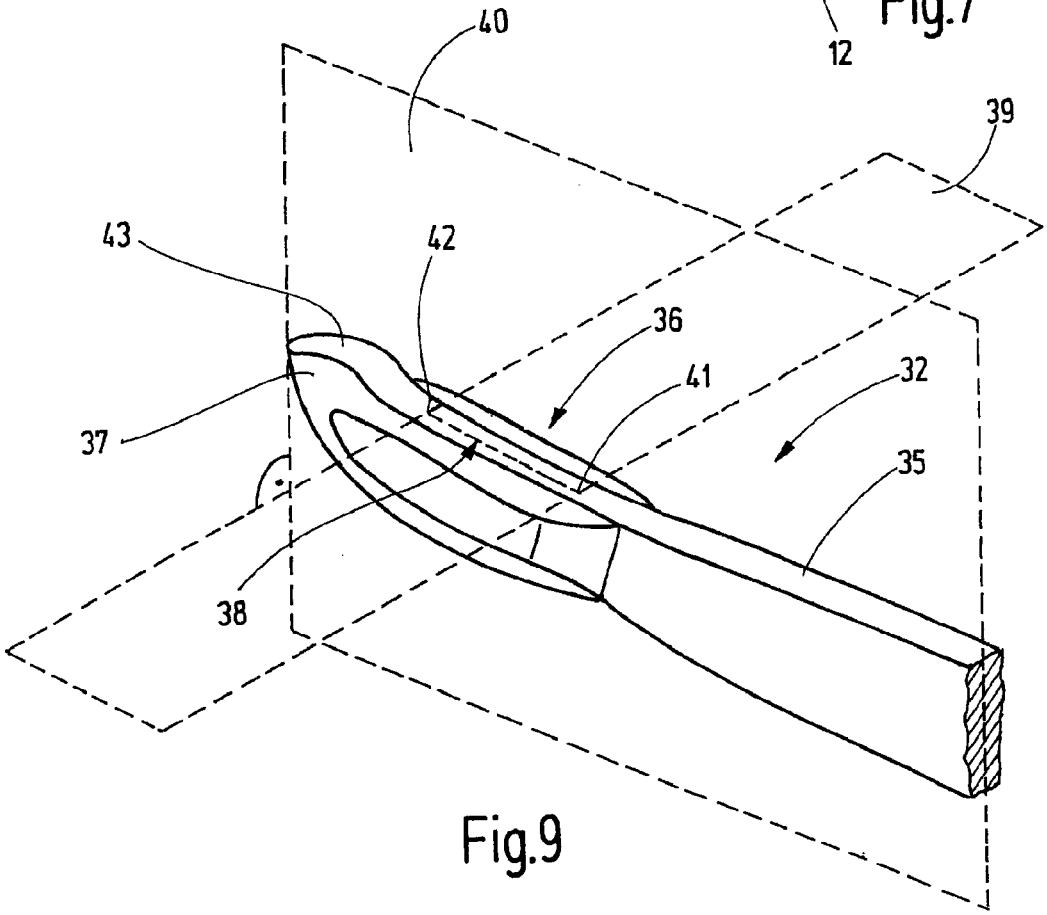
FIG. 9 is a perspective view of a detail, and in a different size, of the latch in accordance with FIG. 8.

FIGS. 7 through 9 illustrate another exemplary embodiment of the invention. This embodiment relates to a male latch-female hook latch-type needle 32. This needle has a recess 33 ("saw cut") on the upper side of its hook 13, whereby an edge of the latch 34 may move to seat itself in said recess.

As is also obvious from FIG. 9, the latch 34 has, adjoining its shank 35, a latch head 36 without recess. On its free end, the latch head 36 terminates in a cam 37. Between the cam 37 and the shank 35, the latch head 36 has a preferably straight edge 38 that, as is shown by the closed position in FIG. 7, moves to seat itself in the recess of the hook. In FIG. 9, the edge is shown in dashed lines, in particular. It defines a plane 39 that extends transversely to the latch 34 and extends at a right angle relative to an imagined center plane 40 of the latch 34. (Such a center plane 40—just like a plane 39 formed by the edge 23—must also be imagined in the latch-type needle 4, 5 and the latch 16 in accordance with FIGS. 1 through 6; however, these are not shown.) The edge 38 extends from a starting point 41 to an endpoint 42 and is preferably straight in this region. The cam 37 extends—with its sliding surface 43 that preferably extends perpendicular to the center plane 40 and with its sliding surface 43 that is curved inside the plane 40—extends beyond this plane 39. The sliding surface 43 extends by preferably at least approximately 0.03 mm beyond the plane 39. In closed position, the sliding surface 43 curves toward the hook 13 and has a convex form in the direction of said hook, as is shown in FIG. 7.

As in the case of the shown needle with the spoon recess (FIGS. 4 through 6) and in the case of the needle with the 15 hook recess (FIGS. 7 through 9), the cam 24 or 37 may be arranged, as illustrated, so as to be symmetrical to the center plane 40 and, alternatively, so as to be asymmetrical thereto. Furthermore, the cam 24 or 37 may, alternatively, be arranged between the shank 18 and the spoon 19 or between the shank 35 and the latch head 36. In each and every embodiment, the sliding surface 28 or 38 is arranged on the cam side that faces the hook 13.

A latch-type needle that is particularly suitable for knitting machines that work without sinkers comprises a latch 16, 34 that preferably carries on its outermost end a cam or extension 24 or 37, said cam or extension being provided with a sliding surface 28, 43. The sliding surface 28, 43 may move along a complementary sliding or runner surface 6, 8 and temporarily prevent the latch 16, 32 from pivoting out of its open position, for example. A corresponding wear of material is concentrated on the sliding surface 28, 43. A damage, deformation or impairment of other parts of the spoon 19 or latch head 36, in particular of its edge 23 or its edge 38, is prevented.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A latch-type needle for knitting machines comprising:

a needle body having a hook on its one end, and comprising:

a latch having a shank and being movable with said shank on the needle body and being supported so as to be movable toward a hook and away from said hook, and having a latch head that, in a closed position, abuts against the hook in order to close the hook, wherein a cam is provided on the latch head, and said cam has a sliding surface which is rounded.

2. The latch-type needle in accordance with claim 1, wherein the cam is arranged on an end of the latch head that extends away from the shank.

3. The latch-type needle in accordance with claim 1, wherein the cam is arranged between the latch head and the shank.

4. The latch-type needle in accordance with claim 1, wherein each, the latch head, the shank and the cam are arranged symmetrically with respect to a latch center plane.

5. The latch-type needle in accordance with claim 1, wherein the latch head has an underside facing the hook, and wherein the sliding surface of the cam extends beyond the underside.

6. The latch-type needle in accordance with claim 5, wherein the sliding surface has a crowned elevation whose peak is located on a latch center plane.

7. The latch-type needle in accordance with claim 1, wherein the cam, measured in longitudinal direction of the latch, has a length that is smaller than the length of a saw cut or an edge measured in a longitudinal direction of the latch.

8. The latch-type needle in accordance with claim 1, wherein the cam, measured in longitudinal direction of the latch, has a length that is smaller than two thirds of the length of a saw cut or an edge measured in a longitudinal direction of the latch.

9. The latch-type needle in accordance with claim 1, wherein the cam has a width that is smaller than a width of the latch head.

10. A latch-type needle for knitting machines, comprising:

a needle body having a hook on its one end, and comprising:

a latch having a shank and being movable with said shank on the needle body and being supported so as to be movable toward a hook and away from said hook, and having a latch head that, in a closed position, abuts against the hook in order to close the hook, wherein a cam is provided on the latch head, and said cam has a sliding surface;

wherein the cam, measured in longitudinal direction of the latch, has a length that is at least one of: smaller than the length of a saw cut or an edge measured in a longitudinal direction of the latch, and smaller than two thirds of the length of a saw cut or an edge measured in a longitudinal direction of the latch.

11. A latch-type needle for knitting machines comprising:

a needle body having a hook on its one end, and comprising:

a latch having a shank and being movable with said shank on the needle body and being supported so as to be movable toward a hook and away from said hook, and having a latch head that, in a closed position, abuts against the hook in order to close the hook, wherein a cam is provided on the latch head, and said cam has a sliding surface; and wherein the cam has a width that is smaller than a width of the latch head.

* * * * *